US005437320A

United States Patent [19]

Sung

[11] Patent Number: 5,437,320

[45] Date of Patent: Aug. 1, 1995

[54] GOLF CLUB PROTECTOR

[76] Inventor: Henry Sung, 19826 E. Vista Hermosa, Walnut, Calif. 91789

[21] Appl. No.: 224,889

[22] Filed: Apr. 8, 1994

[51] Int. Cl.[6] ..... B65D 65/06

[52] U.S. Cl. ..... 150/160; 206/315.4

[58] Field of Search ..... 150/159, 160; 206/315.2, 315.3, 315.4

[56] References Cited

U.S. PATENT DOCUMENTS

| | | | |
|---|---|---|---|
| 3,117,609 | 1/1964 | Pio | 150/160 |
| 3,664,399 | 5/1972 | Neff | 150/160 |
| 4,195,677 | 4/1980 | Hagg et al. | 150/160 |
| 4,497,404 | 2/1985 | Lowrance | 206/315.2 |
| 4,605,050 | 8/1986 | Suk | 150/160 |
| 4,932,523 | 6/1990 | Yamazoe | 206/315.2 X |
| 5,005,624 | 4/1991 | Sung | 150/160 |
| 5,284,194 | 2/1994 | Gaffney | 206/315.2 |

*Primary Examiner*—Allan N. Shoap
*Assistant Examiner*—Christopher J. McDonald
*Attorney, Agent, or Firm*—Erik M. Arnhem

[57] ABSTRACT

A protector device for a golf club includes a rigid tube adapted to house the shaft portion of the club, and a fabric cover adapted to enclose the hitting head of the golf club. The flexible fabric cover includes a flanged panel adapted to underlie the toe area of the club, and a flanged hood adapted to overlie the sole area of the club. The hood flange telescopes over the panel flange to prevent rain water from entering the cover interior space. Access to the cover is achieved by swinging the hood away from the flanged panel.

9 Claims, 2 Drawing Sheets

GOLF CLUB PROTECTOR

BACKGROUND OF THE INVENTION

1. Field of the Invention

This invention relates to golf club protection devices, particularly devices insertable into golf bags for containing an individual golf club separate from other clubs in the bag. The device protects the golf club against possible damage due to rain and/or being struck by other clubs in the bag.

2. Prior Developments

Various covers have been proposed for protecting golf clubs from damage while the clubs are in the golf bag. U.S. Pat. No. 4,368,768 to E. Cunko shows a flexible hood-like cover split into two half sections by a zipper that runs vertically along one side of the cover and around the upper arcuate surface of the cover. A small rigid panel is attached to one face of the cover for mounting one of the cover half sections on a golf bag. The other cover half section can be swung back and forth to permit the head of a golf club to be placed in the cover. The cover is designed to remain attached to the golf bag while the club is in use.

U.S. Pat. No. 3,145,749, to M. Rosenow, shows a form-fitting flexible cover having an interior shape mated to the shape of the hitting head on a conventional golf club. A zipper construction extends along the back surface of the cover, whereby the cover can be opened to fit around the club head. This cover is separate from the golf bag. While the club is in use the golfer carries the cover in his pocket, or places it in some convenient place where it can be retrieved for placement on the club head.

My issued U.S. Pat. No. 5,005,624 shows a golf club protector adapted to be permanently retained in a conventional golf bag. The protector comprises a rigid elongated tube mountable in the golf bag to contain the shaft portion of a conventional golf club, and a flexible fabric cover attached to the upper end of the tube for encircling the head of the club. A slit is formed in an undersurface of the flexible cover, whereby a hood-like portion of the cover can be pulled laterally so that the slit spreads apart to expose the club head. The golfer can remove the golf club from the protector device by lifting the club vertically out of the opened cover and storage tube.

SUMMARY OF THE INVENTION

The present invention relates to a golf club protector device of the type disclosed in my U.S. Pat. No. 5,005,624, i.e. a protector device that includes a rigid storage tube for the golf club shaft, and a flexible cover for the hitting head of the club. The protector device is designed to remain in the golf bag, such that it cannot be mislaid. Also, the device is designed to completely surround the entire golf club, including the shaft and the hitting head, whereby the club is fully protected against damage from the elements or from contact with other clubs in the golf bag.

A principal feature of the invention is that the flexible cover for the club head includes a flanged panel adapted to underlie the toe area of the head of an inverted golf club, and a flanged hood adapted to overlie the sole area of the club head. A perimeter flange on the hood is normally telescoped over an upwardly projecting flange on the panel to protect against migration of rain water into the space circumscribed by the cover. The hood has a hinged connection with a tubular portion of the cover, so that the hood can be drawn away from the flanged lower panel, thereby providing access to the cover interior space for inserting a golf club or removing a golf club.

The hood construction is designed for easy opening of the flexible cover with minimal effort on the part of the golfer. The cover may be constructed of semi-stiff materials, e.g. simulated leather, such that the hood has a self-closing action; when the golfer removes his hand from the hood the hood automatically returns to a nearly closed position. The golfer does not have to make a conscious effort to close the cover.

In preferred practice of the invention the storage tube for the golf club shaft has a lining formed of a soft non-abrasive material, e.g. sheet rubber, felt, or woven cotton fabric. The lining prevents the shaft from being scratched due to contact with the storage tube surface. Also, the lining can act as a sound deadener to prevent noises from being generated due to rattling of the club within the protector device.

THE DRAWINGS

DESCRIPTION OF A PREFERRED EMBODIMENT OF THE INVENTION

Figures 1, 2:
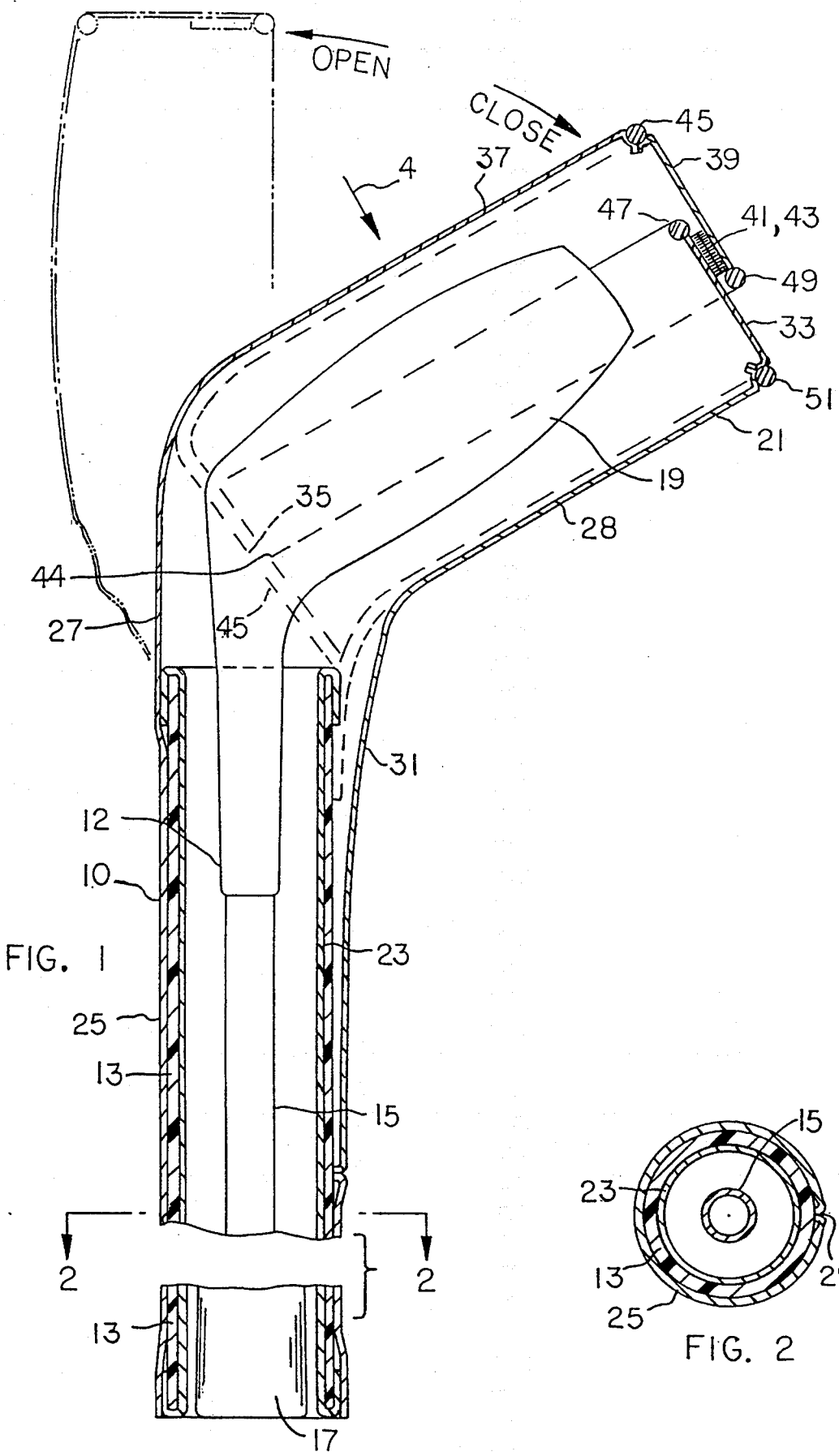
FIG. 1 is a fragmentary longitudinal sectional view taken through a golf club protector device constructed according to the invention.
FIG. 2 is a transverse sectional view taken on line 2—2 in FIG. 1.
Figure 3:
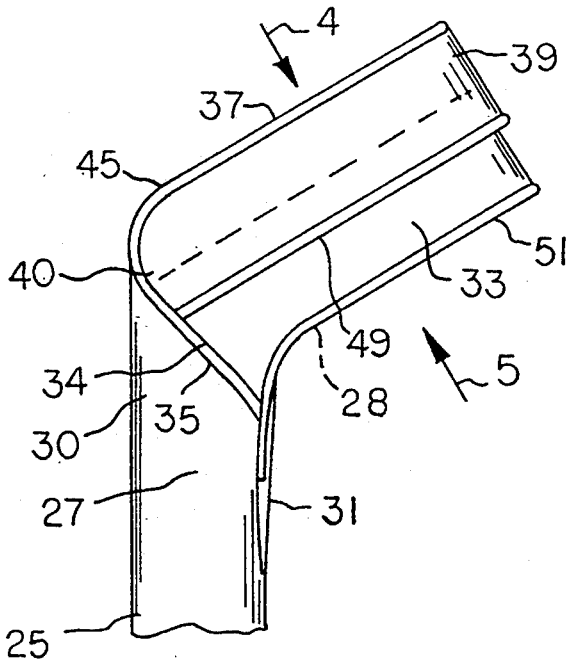
FIG. 3 is a fragmentary side elevational view of the FIG. 1 protector device.

FIGS. 1 through 3 illustrate a golf club protector 10 for housing a conventional golf club 12. The protector comprises a rigid vertical tube 13 having a circular cross section, as viewed in FIG. 2. Typically tube 13 will be formed of a rigid plastic material, and will have a length of about forty three inches; both ends of the tube are open.

As fragmentarily shown in FIG. 1, the golf club 12 is positioned so that its shaft 15 and hand grip 17 are located within tube 13; the hitting head 19 is located within a flexible head cover 21 above the upper end of the rigid tube. The inside diameter of tube 13 is preferably about one and one quarter inch, which provides a slight annular clearance between the tube and the hand grip 17. In order to prevent the club shaft from being scratched by contact with the tube upper edge or tube interior surface, the tube is provided with a lining 23. End portions of the lining preferably extending around the tube edges as shown in FIG. 1.

Lining 23 is formed of a soft material, such as rubber, woven cotton cloth, felt, etc. The lining minimizes noise, as might be generated due to a rattling of the club back and forth in the rigid tube. The lining also prevents the club from being scratched due to contact with the tube surface.

In the illustrated protector, the rigid tube 13 is encased in a sleeve 25 formed of the same material as head cover 21. The material for cover 21 and sleeve 25 is preferably soft and flexible. However the material should be stiff to enable the head cover to retain its shape without distorting or drooping. The stiffness can be controlled by selecting its thickness. One suitable material is a flexible simulated leather material having a sheet thickness of about 0.04 inch. It is believed that various flexible plastic sheet materials can be used for head cover 21 and sleeve 25. Sleeve 25 is installed onto rigid tube 13 by inserting the tube into the sleeve and exerting an axial force on the tube; the tube has a friction fit in the sleeve.

The illustrated protector 10 is designed for placement in a golf bag so that head cover 21 is located above the rim of the bag. A golf club can be inserted into the protector, or removed from the protector, by first opening the cover, as shown in dashed lines in FIG. 1. With the cover opened, a golf club can be readily inserted into the protector or removed from the protector. The golf club is supported in an inverted position, as shown in FIG. 1.

Head cover 21 comprises an elongated tubular portion 27 encircling the upper edge area of rigid tube 13, and a flanged panel 28 angling upwardly and outwardly from the rightmost limit of tubular portion 27 (as viewed in FIG. 1). As shown in FIG. 3, the tubular portion 27 comprises a C cross-sectional portion 30 thereof integral with the aforementioned sleeve 25, and an elongated flap portion 31 integral with panel 28. The flexible sleeve 25 is formed out of a fabric sheet curled into a tubular shape, and sewn together, at 29, to form a vertical seam extending the full length of the sleeve. Hollow portion 30 is an integral extension of sleeve 25.

Panel 28 has a flap portion 31 that fits in a space formed by opposed side edges of sheet portion 30, whereby panel 28 is connected to the tubular portion 27. An arcuate c-shaped flange element 33 projects upwardly from the arcuate perimeter of panel 28 so as to partially encircle the head 19 of the golf club; panel 28 underlies the toe area of the club head. Ends 34 of flange element 33 are sewn to inclined edges 35 of tubular portion 27 to stiffen and rigidify the flanged panel. Panel 28 and flange 33 collectively form an upwardly facing container for the head of the inverted golf club.

A second upper panel 37 extends integrally from tubular portion 27 to form a hood that is adapted to overlie the sole area of club head 19. An arcuate c-shaped upper flange element 39 projects downwardly from the arcuate perimeter of panel 37 to form a hood partially surrounding the club head. Ends 40 of the arcuate flange element are sewn to inclined edges 35 of tubular portion 37 to form a relatively rigid hood structure.

Figure 4:
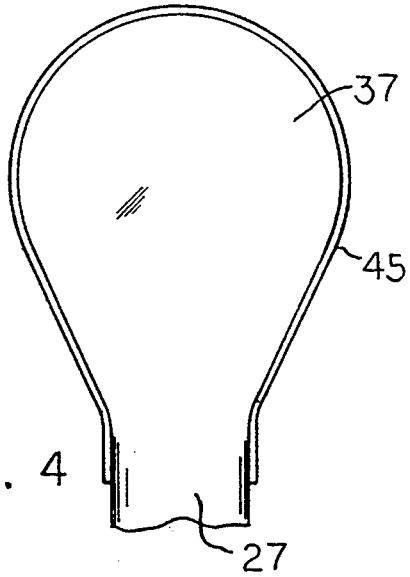
FIG. 4 is a fragmentary view on a reduced scale, taken in the direction of arrow 4 in FIG. 1 and 3.
Figure 5:
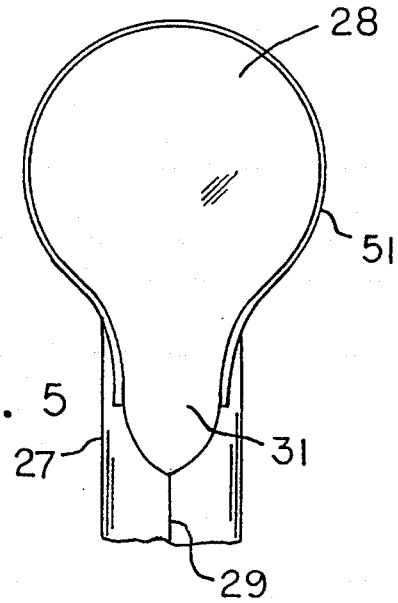
FIG. 5 is a fragmentary view taken in the direction of arrow 5 in FIG. 3.

As viewed in FIGS. 4 and 5, panels 28 and 37 have tear drop shapes defined by generally circular perimeter edges. The diameter of panel 37 is somewhat larger than that of panel 28, such that the upper hood is adapted to telescope over the flanged panel 28 when the hood is in its closed position (FIG. 1). Flange elements 33 and 39 are dimensioned so that flange element 39 fits around flange element 33 to prevent rain water from migrating into the cover interior space.

As an optional feature, patches of an adhesive material can be affixed to the facing surfaces of flange elements 33 and 39 whereby the hood is ensured of remaining in a closed position under windy conditions. FIGS. 1 and 3 show adhesive patches 41 and 43 on flange elements 33 and 39 for releasbly holding the hood in its closed position. Patches 41 and 43 can be formed out of a fibrous hood-and-loop material marketed under the tradename VELCRO.

FIG. 1 shows, in dashed lines, the hood pulled away from flanged panel 28 for accessing the interior space within the head cover. The hood pivots generally around imaginary hinge point 44 through an angle that measures about sixty degrees. The hood is capable of a greater arcuate motion; however a sixty degree movement is sufficient for the intended purpose of removing a golf club or inserting a golf club.

While the club is being moved into or out of the protector the hood is held in its open position. When manual pressure on the hood is removed the hood automatically returns to approximately the position shown in FIG. 1. Some manual force may be needed to insure interlocking connection of the adhesive patches 41 and 43, however.

The automatic return of the hood toward its closed position is due largely to the fact that the ends of flange elements 33 and 39 are sewn to common inclined edges 35 on tubular portion 27. Another factor is the presence of a continuous bead 45 extending around the perimeter of upper panel 37 and along inclined edges 35.

The arcuate free edges of flange elements 33 and 39 are somewhat stiffened by beads 47 and 49 that terminate at (join) bead 45. Panel 28 is somewhat stiffened by a bead 51 that runs along the panel perimeter so as to join bead 45 along the joint between tubular portion 27 and flap 31. The system of beads reinforces the fabric cover elements so that the cover is better able to retain its initial shape without sagging or drooping.

A major feature of the invention is the openable hood that normally telescopes over the flanged panel 28 to prevent rain from migrating into the cover interior space. The hood is readily swung open to the FIG. 3 position without a great deal of effort. No zippers or fasteners are required to hold the hood in place. The hood is self-actuated toward its closed position.

What is claimed is:

1. A golf club protector comprising an elongated rigid tube adapted to assume an upright vertical position in a golf bag for housing the shaft of an inverted golf club, and a flexible head cover extending upwardly from said rigid tube to entirely surround the hitting head of the inverted golf club;

said flexible head cover comprising a flexible tubular sleeve (25,27) encircling at least an upper edge area of said rigid tube; said sleeve having spaced upper edges (35) acutely angled to the sleeve axis, with each acutely angled edge having a lower end and an upper end;

a lower panel (28 joined to said sleeve at a point between the lower ends of said acutely angled edges, said lower panel having an arcuate edge extending between the lower ends of said acutely angled edges; a first arcuate flange (33) joined to the arcuate edge of said lower panel and to said acutely angled edges, whereby said lower panel and said first flange cooperatively form an upwardly facing container for the head of an inverted golf club;

an upper panel (37) joined to said sleeve at a point between the upper ends of said acutely angled edges; said upper panel having an arcuate edge that forms a continuation of said acutely angled edges; a second arcuate flange (39) joined to the arcuate edge of said upper panel and to said acutely angled edges, whereby said upper panel and said second flange cooperatively form a hood adapted to fit over the aforementioned container;

The flange on said lower panel being normally telescoped within the flange on said upper panel, whereby the hood prevents rain water from migrating into the flexible cover;

said hood being hingedly joined to the acutely angled upper edges of said sleeve so that the hood can be pulled away from said lower panel, for removing a golf club from the protector or inserting a golf club into the protector; said hood having a normal closed position wherein the flange on said lower panel is telescoped within the flange on the upper panel.

2. The golf club protector of claim 1, and further comprising a first bead (47) extending along an upper edge of said first flange; and a second bead (49) extending along a lower edge of said second flange; said beads constituting reinforcements for stiffening the edges of the respective flanges.

3. The golf club protector of claim 1, wherein said tubular sleeve is extended downwardly to have a telescopic fit on at least the upper portion of said rigid tube.

4. The golf club protector of claim 3, wherein said sleeve extends to the entire length of said rigid tube.

5. The golf club protector of claim 1, and further comprising a relatively soft, non-abrasive liner within said rigid tube for shielding the golf club from scratching.

6. The golf club protector of claim 1, wherein said upper panel (37) is an integral flap-type extension of said tubular sleeve.

7. The golf club protector of claim 1, wherein the flexible head cover is formed of a flexible material that enables said hood to swing around said acutely angled upper edges through an arc of at least sixty degrees in order to gain access to the space within the head cover.

8. The golf club protector of claim 7, wherein the head cover material has sufficient stiffness as to cause said hood to automatically swing toward a closed position in the absence of manual force on the cover.

9. The golf club protector of claim 1, wherein said tubular sleeve has a telescopic fit on said rigid tube; said tubular sleeve extending the entire length of said tube; said sleeve comprising a fabric strip extending longitudinally along said tube, and having side edges joined together to form a longitudinal seam (29); said upper panel (37) being an integral flap-type extension of said tubular sleeve; said lower panel (28) having an integral flap (31) joined to said tubular tubular sleeve at the upper end of said logitudinal seam.

* * * * *